US009436154B2

(12) United States Patent
Hayayumi

(10) Patent No.: US 9,436,154 B2
(45) Date of Patent: Sep. 6, 2016

(54) SHEET CONTAINING APPARATUS HAVING A CONTAINING PORTION WITH LOCK MECHANISM AND AN IMAGE FORMING APPARATUS HAVING A CONTAINING PORTION WITH LOCK MECHANISM

(71) Applicant: CANON KABUSHIKI KAISHA, Tokyo (JP)

(72) Inventor: Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 14/509,848

(22) Filed: Oct. 8, 2014

(65) Prior Publication Data

US 2015/0104232 A1 Apr. 16, 2015

(30) Foreign Application Priority Data

Oct. 10, 2013 (JP) ..... 2013-212750

(51) Int. Cl.

| | |
|---|---|
| ***G03G 15/00*** | (2006.01) |
| ***G03G 21/16*** | (2006.01) |
| *B65H 1/02* | (2006.01) |
| *B65H 1/26* | (2006.01) |

(52) U.S. Cl.

CPC ..... *G03G 21/1647* (2013.01); *G03G 21/1619* (2013.01); *B65H 1/027* (2013.01); *B65H 1/266* (2013.01); *B65H 2402/32* (2013.01)

(58) Field of Classification Search

CPC .. A47B 88/10; A47B 88/16; A47B 88/0085; A47B 2088/0059; A47B 2088/0088; A47B 2088/0433; B65H 2402/32; B65H 1/266; B65H 1/027; B65H 2301/42254; B65H 2301/422542; B65H 2301/422546; B65H 2301/422544; B65H 2301/422548; B65H 2405/10; B65H 2405/11; B65H 2405/20; B65H 2405/21; B65H 2405/32

USPC ..... 312/334.44, 334.47, 334.45

See application file for complete search history.

(56) References Cited

U.S. PATENT DOCUMENTS

| | | | | |
|---|---|---|---|---|
| 4,765,699 A * | 8/1988 | Bessinger | ..... | A47B 88/16 312/334.46 |
| 5,358,322 A * | 10/1994 | McLaughlin | ..... | E05B 65/462 312/219 |
| 8,469,352 B2 * | 6/2013 | Kunioka | ..... | B41J 13/106 271/164 |

FOREIGN PATENT DOCUMENTS

| | | |
|---|---|---|
| JP | 3516376 B2 | 4/2004 |
| JP | 3571910 B2 | 9/2004 |

* cited by examiner

*Primary Examiner* — Blake A Tankersley
*Assistant Examiner* — Quang X Nguyen
(74) *Attorney, Agent, or Firm* — Canon U.S.A. Inc., IP Division

(57) ABSTRACT

An image forming apparatus which includes: a containing portion configured to contain a sheet on which an image is to be formed; a pair of guide rails facing in an up-down direction, the guide rails guiding a slide movement of the containing portion; an engaging portion provided in the guide portion that is guided by the guide rails; a first stopper which abuts the engaging portion so as to regulate removal of the containing portion from an apparatus main body; and a second stopper, wherein the first stopper is movable in a sliding direction.

16 Claims, 8 Drawing Sheets

SHEET CONTAINING APPARATUS HAVING A CONTAINING PORTION WITH LOCK MECHANISM AND AN IMAGE FORMING APPARATUS HAVING A CONTAINING PORTION WITH LOCK MECHANISM

BACKGROUND OF THE INVENTION

1. Field of the Invention

The present invention relates to an image forming apparatus which forms an image on a sheet.

2. Description of the Related Art

An image forming apparatus, such as a printer and a copier, includes a containing cassette as a containing portion in which sheets are contained in a stacked manner. The sheet is fed from the containing cassette and an image is formed on the sheet. When the containing cassette is replenished with sheets, the containing cassette is pulled from an apparatus main body of the image forming apparatus. Further, it is necessary to remove the containing cassette from the apparatus main body for, for example, the maintenance of the apparatus.

A configuration provided with a stopper for regulating removal of the containing cassette from the apparatus main body when the containing cassette is pulled from the apparatus main body has been proposed. By regulating the pulling of the containing cassette by the stopper on the way, replenishment of the sheets and the like may be performed easily. By releasing the stopper and removing the containing cassette from the apparatus main body, maintenance and the like may be performed easily. Japanese Patent No. 3516376 proposes a configuration in which a user lifts a containing cassette and releases regulation of a stopper, whereby the containing cassette becomes removable from the apparatus main body. Japanese Patent No. 3571910 proposes a configuration in which a stopper for regulating removal is swingably attached to a containing cassette and, when a user manually moves the stopper to a position at which regulation is released, the containing cassette becomes removable.

In the configuration of Japanese Patent No. 3516376, when the user lifts the containing cassette, the containing cassette becomes removable. In this apparatus, however, there is a possibility that the containing cassette is removed from the apparatus main body even when the user does not intend to remove the containing cassette. In the configuration of Japanese Patent No. 3571910, there is a possibility that the user makes the stopper swing unintentionally and the containing cassette may be removed.

In a case in which the containing cassette is unintendedly removed in this manner, it is possible that, for example, the user will be at a loss how to attach the removed containing cassette to the apparatus main body again. It is also possible that the user breaks the apparatus in an attempt to attach the containing cassette by force without knowing how to attach the same.

SUMMARY OF THE INVENTION

The present invention aims to reliably prevent removal, which is not intended by a user, of a containing cassette as a containing portion.

An image forming apparatus of the present invention includes a containing portion configured to contain a sheet on which an image is to be formed and configured to be slidably supported by an apparatus main body, a pair of guide rails provided in the apparatus main body and facing each other in an up-down direction, the guide rails being configured to guide a slide movement of the containing portion, a guide portion provided in the containing portion and guided by the pair of guide rails between the pair of guide rails, an engaging portion provided at an end portion in a sliding direction of the guide portion, the engaging portion including a projecting portion projecting upward and a projecting portion projecting downward, a first stopper provided to project from one guide rail of the pair of guide rails toward the other guide rail of the pair of guide rails, and configured to abut the engaging portion to regulate removal of the containing portion from the apparatus main body, and a second stopper provided to project from the other guide rail toward the one guide rail, and configured to abut the engaging portion to regulate removal of the containing portion from the apparatus main body, wherein the first stopper is movable in a sliding direction from a position at which removal of the containing portion from the apparatus main body is regulated where a distance between the first stopper and the second stopper is shorter than a thickness in the up-down direction of the engaging portion to a position at which removal of the containing portion from the apparatus main body is released where the distance between the first stopper and the second stopper is longer than the thickness of the engaging portion.

Further features of the present invention will become apparent from the following description of exemplary embodiments with reference to the attached drawings.

DESCRIPTION OF THE EMBODIMENTS

Figure 1C:
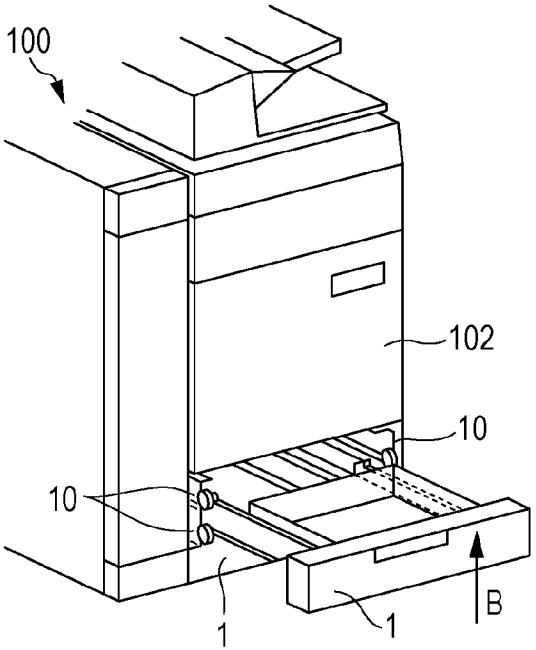
FIGS. 1A to 1C illustrate an image forming apparatus according to an embodiment of the present invention.
Figure 1B:
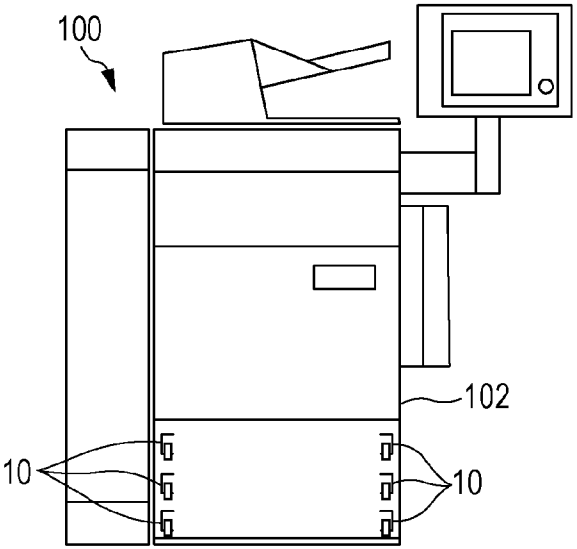
Figure 1A:
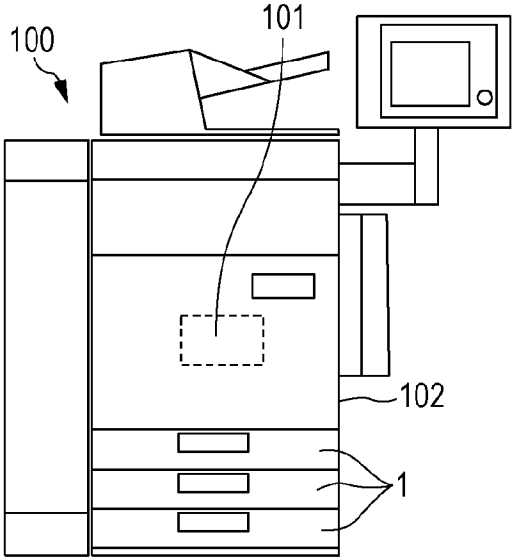

FIGS. 1A to 1C illustrate an image forming apparatus 100 as an exemplary embodiment according to the present invention. FIG. 1A is a front view of the image forming apparatus 100, FIG. 1B is a front view of the image forming apparatus 100 in a state in which a containing cassette 1 is removed, and FIG. 1C is a perspective view of the image forming apparatus 100 in a state in which the containing cassette 1 is pulled.

A containing cassette 1 as a containing portion which stores sheets in a stacked state is provided in the image forming apparatus 100. The containing cassette 1 may be pulled in the front side of an apparatus main body 102 by a pulling device 10. The containing cassette 1 is provided so that paper sheets, OHT sheets and the like may be placed by a user as sheets on which images are to be formed. The containing cassette 1 is replenished with sheets in a state in which the containing cassette 1 is pulled in the front side of the apparatus as illustrated in FIG. 1C. In the present embodiment, three containing cassettes 1 of the same configuration are arranged in an up-down direction.

The sheets contained in the containing cassette 1 are fed to the apparatus main body 102 and an image is formed thereon by the image forming unit 101. For example, an image is formed on the sheet in accordance with image information read by an image reading unit provided in the image forming apparatus 100 or in accordance with image information transmitted to the image forming apparatus 100 via an external connection cable.

Figure 7A:
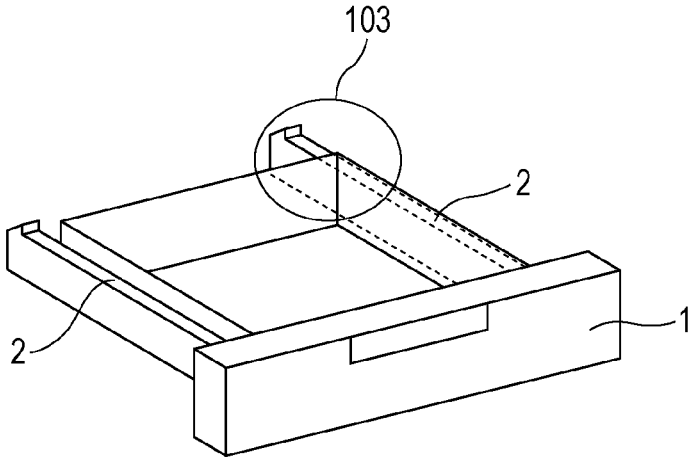
FIGS. 7A and 7B are perspective views of a containing cassette.
Figure 7B:
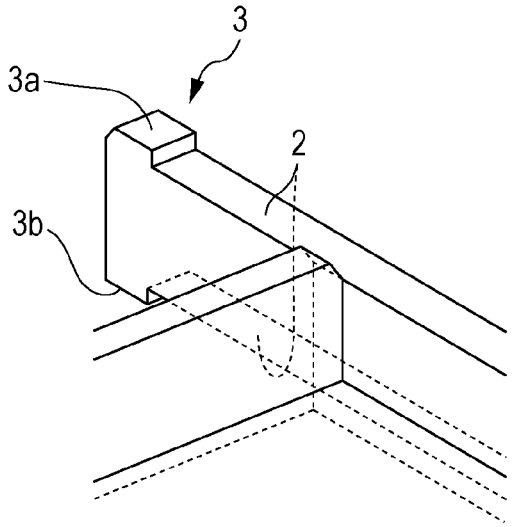

As illustrated in FIGS. 7A and 7B, guide members (i.e., guide portions) 2 are provided at both sides of the containing cassette 1 (i.e., end portions of a direction that crosses a sliding direction). The guide members 2 are supported by the pulling device 10 and extend along side surfaces of the containing cassette 1. At an end portion of the guide member 2, as illustrated in FIG. 7B which is an enlarged view of 103 of FIG. 7A, a cassette stopper 3 is provided. The cassette stopper 3 is formed as an engaging portion that includes a first projecting portion 3*a* protruding upward and a second projecting portion 3*b* protruding downward.

Next, the pulling device 10 that is provided in the apparatus main body 102 and supports the containing cassette 1 in a pullable manner will be described in detail.

First Embodiment

Figure 2A:
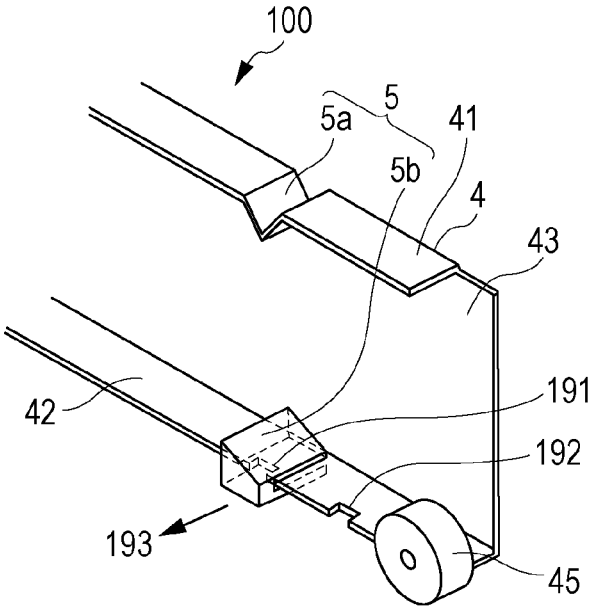
FIGS. 2A and 2B are perspective views of a first embodiment of the present invention.
Figure 2B:
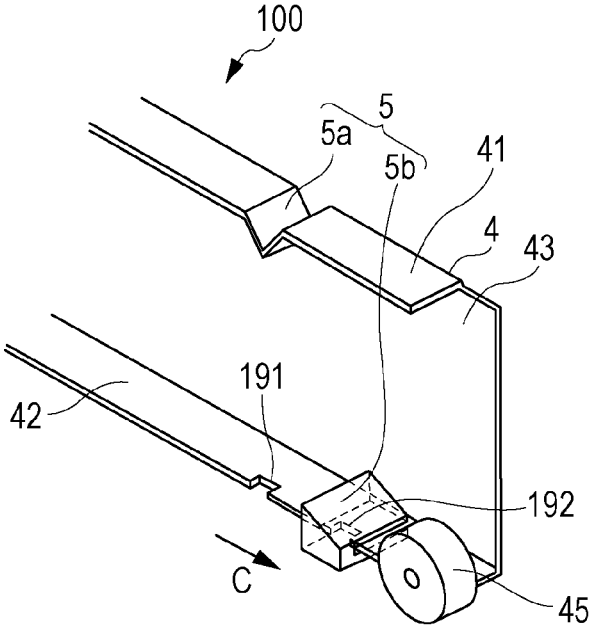
Figure 3A:
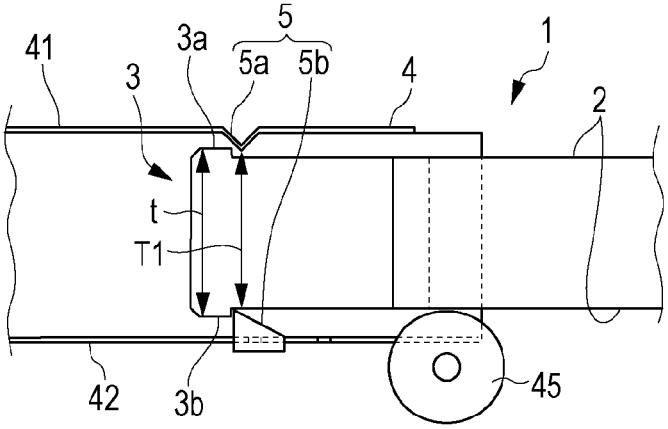
FIGS. 3A to 3C are explanatory views illustrating an operation of the first embodiment of the present invention.
Figure 3B:
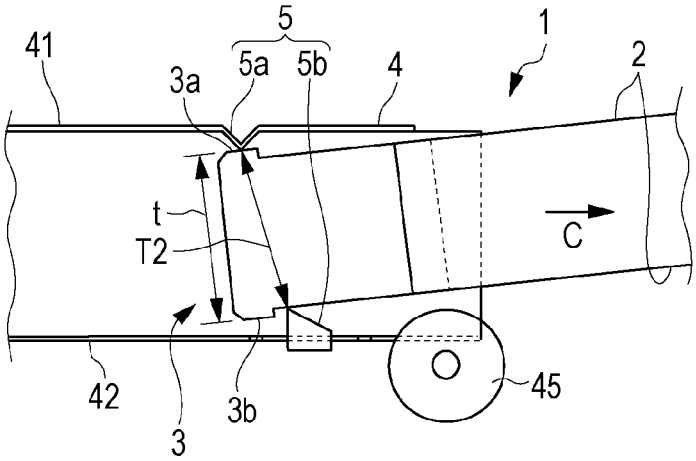
Figure 3C:
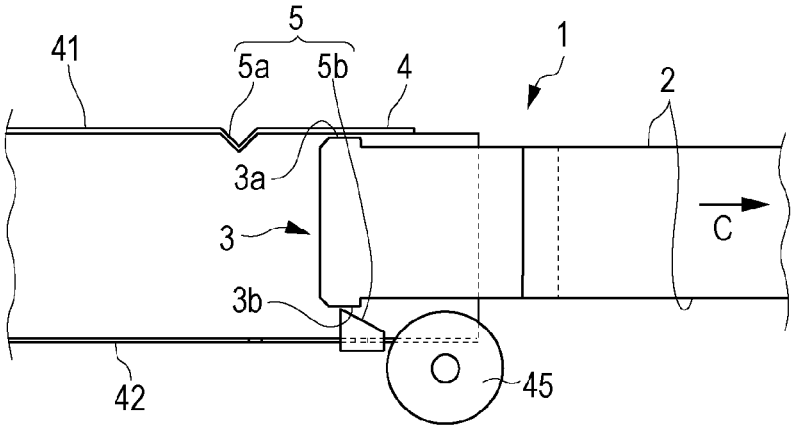

Hereinafter, a pulling device 10 according to a first embodiment will be described. FIGS. 2A and 2B are perspective views illustrating a configuration of the pulling device 10 disposed in the apparatus main body 102. FIGS. 3A, 3B and 3C are explanatory views of an operation of the pulling device 10.

As illustrated in FIGS. 2A and 2B, the pulling device 10 includes guide rails 4 as guide units disposed to face each other at both sides of the containing cassette 1. The guide rails 4 extend in a direction in which the containing cassette 1 is pulled, and slidably support the containing cassette 1 in the sliding direction. Each guide rail 4 includes an upper guide rail portion 41, a lower guide rail portion 42, and a side surface portion 43 that connects the upper guide rail portion 41 and the lower guide rail portion 42. The guide rail 4 has a substantially U-shaped cross section.

The containing cassette 1 is attached to the pulling device 10 such that the guide member 2 is disposed between the upper guide rail portion 41 and the lower guide rail portion 42 (see FIGS. 3A to 3C). That is, the guide rail 4 supports the guide member 2 provided in the containing cassette 1, and guides the containing cassette 1 when it is pulled or attached/detached.

In particular, when the containing cassette 1 is pulled, the guide member 2 provided in the containing cassette 1 is slidably guided in a horizontal direction. At this time, a movement of the guide member 2 provided in the containing cassette 1 in the up-down direction is regulated by the upper guide rail portion 41 and the lower guide rail portion 42 of the guide rail 4. In this manner, the containing cassette 1 is pulled from the apparatus main body 102 while being guided by a pair of guide rails: the upper guide rail portion 41 and the lower guide rail portion 42.

A rotatable guide roller 45 that supports the guide member 2 of the containing cassette 1 is disposed in the lower guide rail portion 42.

The guide rail 4 includes a sliding portion in which the guide member 2 slides against the guide rail 4 disposed across the entire area from the front side to the back side of the apparatus main body 102. A rail stopper 5 is provided in the guide rail 4 on the front side of the apparatus main body. The rail stopper 5 is disposed at a position to abut (i.e., engage) the cassette stopper 3 when the containing cassette 1 is pulled to a sufficient amount so that the largest sized sheet may be placed on the containing cassette 1. In this manner, the maximum pulling amount of the containing cassette 1 may be controlled by the rail stopper 5.

The rail stopper 5 is formed by a movable rail stopper 5*b* as a first stopper and a fixed rail stopper 5*a* as a second stopper that are disposed to face each other.

The fixed rail stopper 5*a* is provided to project downward (i.e., toward the lower guide rail portion 42 which is a second guide rail) from the upper guide rail portion 41 which is a first guide rail of the pair of guide rails.

The movable rail stopper 5*b* is provided to project upward (i.e., toward the upper guide rail portion 41 which is the first guide rail) from the lower guide rail portion 42 which is the second guide rail. The movable rail stopper 5*b* is detachably, i.e., movably, attached to the lower guide rail portion 42. A first notch 191 and a second notch 192 are formed in the lower guide rail portion 42.

In normal use, the movable rail stopper 5*b* is attached to a stopper position illustrated in FIGS. 2A and 3A. When the movable rail stopper 5*b* is in the stopper position, the movable rail stopper 5*b* fits into and engages the first notch 191. Since the movable rail stopper 5*b* engages the first notch 191, the movable rail stopper 5*b* is locked to regulate a movement of the containing cassette 1 in the direction in which the containing cassette 1 is pulled.

In this case, when the containing cassette 1 is pulled to the stopper position where the pulling amount becomes the maximum, the movement of the containing cassette 1 is regulated in the following manner. That is, as illustrated in FIG. 3A, the cassette stopper 3 as the engaging portion provided at the end portion of the guide member 2 of the containing cassette 1 abuts the fixed rail stopper 5*a* and the movable rail stopper 5*b*. Here, the maximum thickness of the cassette stopper 3 in the up-down direction is set to t. The maximum thickness of the cassette stopper 3 as the engaging portion in the up-down direction is a distance between an upper surface of the first projecting portion 3*a* and a lower surface of the second projecting portion 3*b*. In the state illustrated in FIG. 3A, the maximum thickness t and a distance between the movable rail stopper 5*b* and the fixed rail stopper 5*a* are set so that the shortest distance T1 between the movable rail stopper 5*b* and the fixed rail stopper 5*a* becomes smaller than the maximum thickness t. Therefore, since the cassette stopper 3 is not able to pass through between the rail stoppers, pulling of the containing cassette 1 is regulated. Therefore, the containing cassette 1 is not removed from the apparatus main body 102.

Next, when the containing cassette 1 is removed from the apparatus main body 102, an operator who performs maintenance of the apparatus first moves the movable rail stopper 5*b* in the arrow 193 direction (see FIG. 2A) and releases the engagement between the movable rail stopper 5*b* and the first notch 191. The operator then slidingly moves the movable rail stopper 5*b* in the direction of arrow C, as illustrated in FIG. 2B to a release position provided on the side in a direction in which the containing cassette 1 is pulled. Next, the operator pushes the movable rail stopper 5*b* into the direction opposite to the direction of arrow 193 so as to fit the movable rail stopper 5*b* into the second notch 192. Since the movable rail stopper 5*b* engages the second notch 192, the movable rail stopper 5*b* is locked so as not to move in the direction in which the containing cassette 1 is pulled.

In this case, when the containing cassette 1 is pulled, the cassette stopper 3 first abuts the fixed rail stopper 5*a*, but does not abut the movable rail stopper 5*b* (see FIG. 3B). Further, the shortest distance T2 between the movable rail stopper 5*b* and the fixed rail stopper 5*a* is set to be sufficiently long with respect to the maximum thickness t of the cassette stopper 3. Therefore, as illustrated in FIGS. 3B and 3C, since the cassette stopper 3 may pass through between the fixed rail stopper 5*a* and the movable rail stopper 5*b*, the containing cassette 1 may be removed from the apparatus main body 102.

That is, when the containing cassette 1 is to be removed from the apparatus main body 102 for, for example, the maintenance of the apparatus, the front side of the containing cassette 1 is lifted in the direction of B as illustrated in FIG. 1C in a state in which the containing cassette 1 has been pulled to the maximum. When the containing cassette 1 is further pulled in this state in which the containing cassette 1 is inclined, the containing cassette 1 may be removed from the apparatus main body 102 without being regulated by the rail stoppers 5*a* and 5*b*.

Here, the release position of the movable rail stopper 5*b* illustrated in FIG. 2B is set to be separated from a stop position illustrated by FIG. 2A. Therefore, if the movable rail stopper 5*b* is attached to the release position, the containing cassette 1 may be detached and attached easily. Therefore, highly reliable stopper configuration and high maintainability may be achieved at the same time.

COMPARATIVE EXAMPLE

Figure 8A:
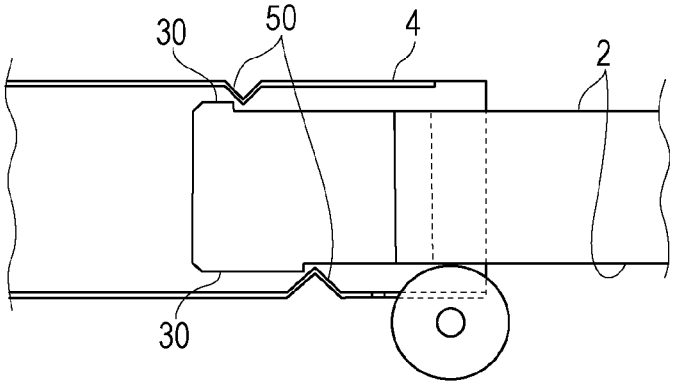
FIGS. 8A to 8C are diagrams illustrating Comparative Example.
Figure 8B:
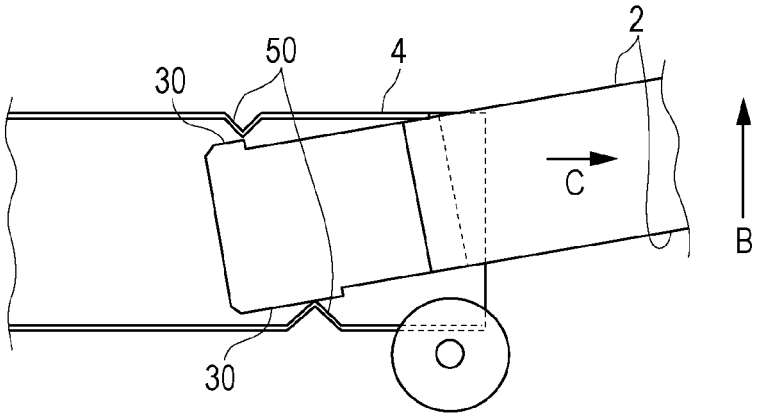
Figure 8C:
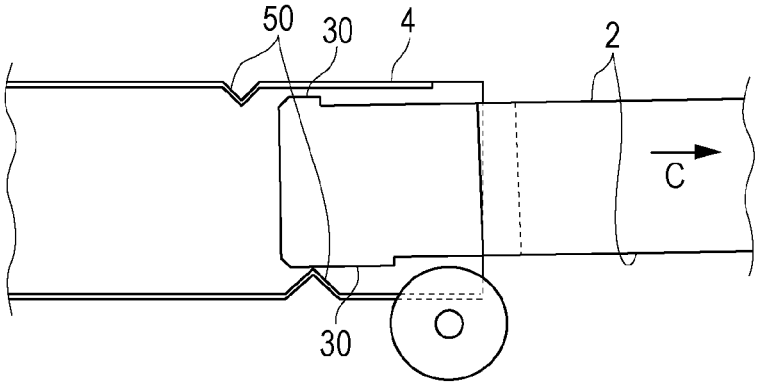

FIGS. 8A to 8C illustrate an example as Comparative Example in which rail stoppers 50 are provided at fixed positions at which the containing cassette is removable. When a user pulls the containing cassette lifting a handle of the containing cassette for the replacement and replenishment of the sheets or pulls the containing cassette suddenly, the containing cassette may be unintendedly removed from the apparatus main body. In such a case, there is a possibility that the containing cassette is damaged, or that the removed containing cassette 1 is damaged when being attached again using force. In some cases, there is also a possibility that inner components may be damaged by a user who may touch them through an opening of the apparatus main body through which the containing cassette has been pulled out.

As compared with Comparative Example, in the present embodiment, if the movable rail stopper 5*b* is attached to the stopper position illustrated in FIG. 2A, the containing cassette 1 is not able to be removed from the apparatus main body 102. Therefore, unintended removal of the containing cassette 1 is avoided. Further, since the movable rail stopper 5*b* is movable from the stopper position illustrated in FIG. 2A, it is possible to remove the containing cassette 1 from the apparatus main body 102 when maintenance is necessary.

Second Embodiment

Next, a pulling device according to a second embodiment of the present invention will be described.

Figure 4A:
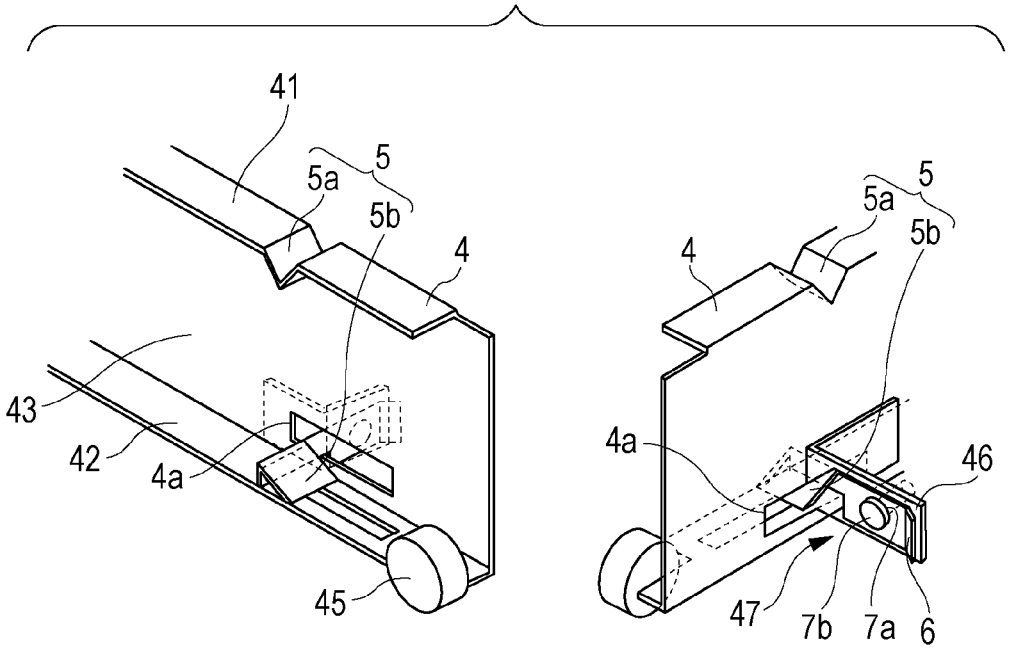
FIGS. 4A and 4B are perspective views of a second embodiment of the present invention.
Figure 4B:
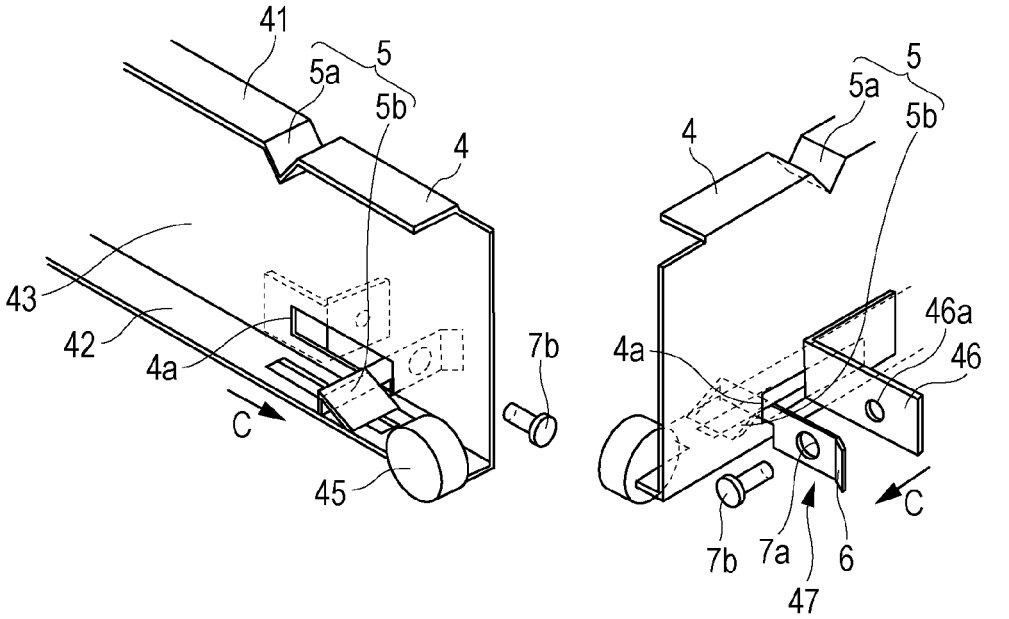
Figure 5A:
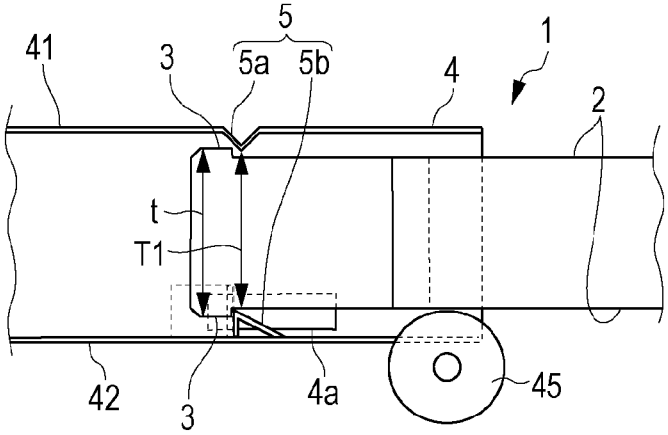
FIGS. 5A to 5C are explanatory views illustrating an operation of the second embodiment of the present invention.
Figure 5B:
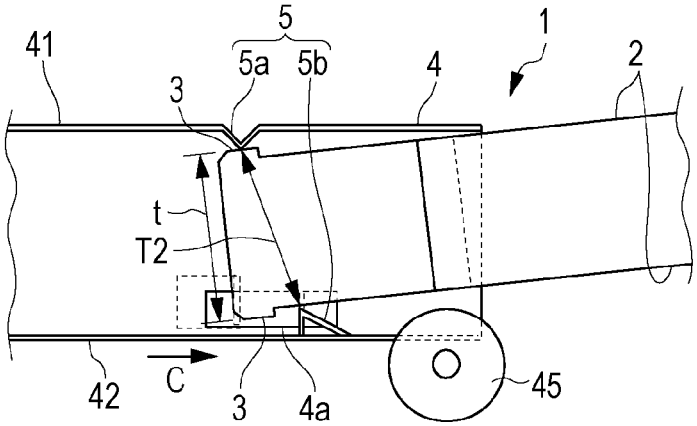
Figure 5C:
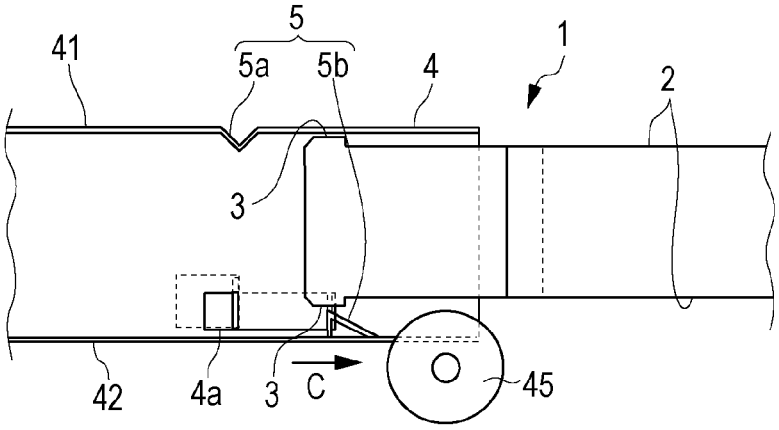

FIGS. 4A and 4B are perspective views illustrating the pulling device of the second embodiment. FIG. 4A illustrates the stopper position and FIG. 4B illustrates the release position of a rail stopper portion. FIGS. 5A, 5B and 5C are explanatory view of an operation of the pulling device of the second embodiment.

An opening 4*a* is provided in a side surface portion 43 of the guide rail 4 near the movable rail stopper 5*b*. The movable rail stopper 5*b* is provided to extend, through the opening 4*a*, from the outside to the inside (i.e., the side in which the paper cassette 1 is guided) of the guide rail 4. That is, via the side surface portion 43, the movable rail stopper 5*b* is provided on the side on which the containing cassette 1 is to be attached, and operating unit 47 connected to the movable rail stopper 5*b* is provided on the side on which the containing cassette 1 is not attached. The operating unit 47 is inserted in the opening 4*a* from the inside of the guide rail 4 and is disposed outside. The movable rail stopper 5*b* is disposed inside (i.e., a side on which the containing cassette 1 is guided) the guide rail 4 which has a substantially U-shaped cross section, and the operating unit 47 is disposed outside the guide rail 4 which has a substantially U-shaped cross section.

A fixing plate 46 is attached to the side surface portion 43 at a position corresponding to the stopper position of the movable rail stopper 5. The fixing plate 46 is a plate-shaped member extending perpendicular to the side portion 43 and extending in the vertical direction. A threaded hole 46*a* is formed in the fixing plate 46.

The operating unit 47 connected to the movable rail stopper 5*b* is operated by the operator when the movable rail stopper 5*b* is moved. In the operating unit 47, a knob portion 6 for switching the movable rail stopper 5*b* between the stopper position and the release position, and a fastening portion 7*a* for fixing the movable rail stopper 5*b* to the guide rail 4 at the stopper position are provided. The fastening portion 7*a* which has a hole through which the fastening member 7*b* is inserted faces the fixing plate 46. The fastening portion 7*a* is a portion for fixing the movable rail stopper 5*b* to the fixing plate 46.

Since the operating unit 47 is disposed outside the guide rail 4 which has a substantially U-shaped cross section, i.e., on the side on which the containing cassette 1 is not attached, the operation by the operator is easy.

In normal use, the movable rail stopper 5*b* is at the stopper position as illustrated in FIGS. 4A and 5A. The movable rail stopper 5*b* is fixed to the fixing plate 46 of the guide rail 4 by the fastening member (i.e., the fixing member) 7*b* which is the screw inserted in the threaded hole 46*a*. With this configuration, even if the containing cassette 1 is pulled to the maximum pulled position as in the first embodiment, the cassette stopper 3 abuts the rail stopper 5 and further pulling is regulated, whereby removal of the containing cassette 1 from the apparatus main body is avoided.

Next, when the containing cassette 1 is removed from the apparatus main body, the fastening member 7*b* is removed and fixation of the movable rail stopper 5*b* is released. Fixation of the movable rail stopper 5*b* is released by removing the fastening member 7*b* from the front side of the image forming apparatus using a tool (i.e., a driver).

Then, as illustrated in FIG. 4B, the operator moves the knob portion 6 in the direction of arrow C and moves the movable rail stopper 5*b* to the release position. At the release position, as in the release position in the first embodiment, the cassette stopper may pass through between the fixed rail stopper 5*a* and the movable rail stopper 5*b* as illustrated in FIGS. 5B and 5C. Therefore, the containing cassette 1 may be pulled from the apparatus main body 102 and removed from the apparatus main body 102.

In the present embodiment, the knob portion 6 and the fastening portion 7*a* for fastening using the fastening member 7*b* are provided in the movable rail stopper 5*b*. Since the movable rail stopper 5*b* is fixed by the fastening member 7*b* which is a screw, the stopper configuration is higher in robustness than a configuration in which a stopper is positioned without fastening using a fastening member (i.e., a fixing member). Since the operation by the operator to the operating unit 47 is easy, maintainability is high. That is, in the present embodiment, both the robustness and maintainability are high.

In the present embodiment, an example in which the opening 4*a* is provided in the side surface portion 43 of the guide rail 4 is illustrated. Alternatively, an opening may be provided in the lower guide rail portion 42 of the guide rail 4 and the operating unit 47 may be provided to extend below the guide rail 4.

Third Embodiment

Next, a pulling device according to the third embodiment of the present invention will be described.

Figure 6A:
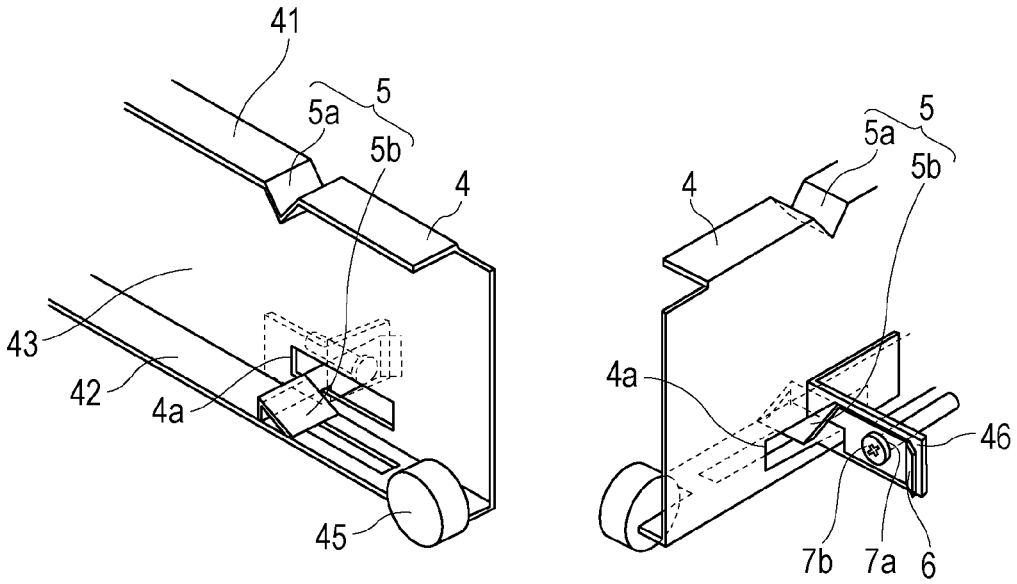
FIGS. 6A and 6B are perspective views of a third embodiment of the present invention.
Figure 6B:
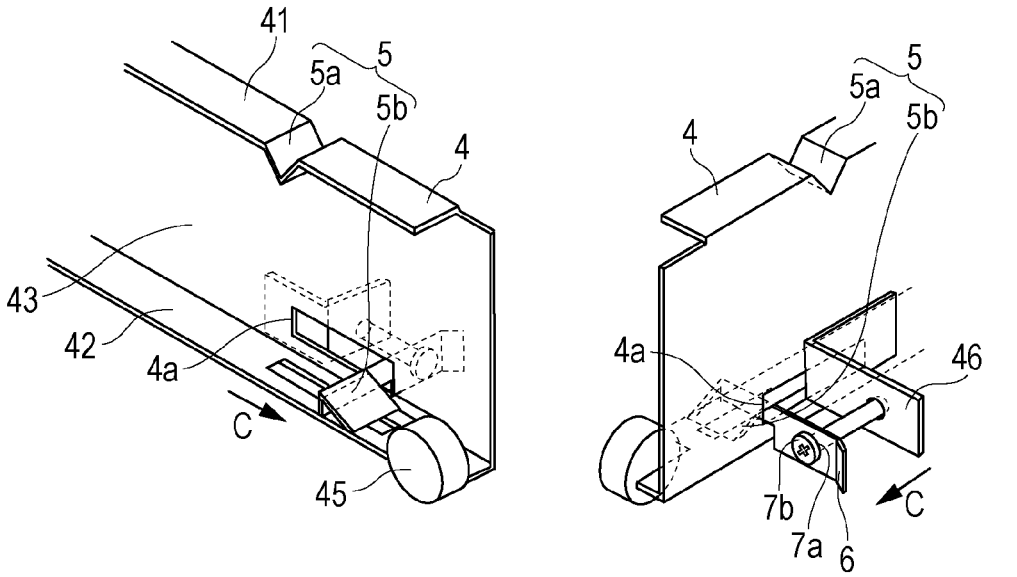

FIGS. 6A and 6B are perspective views illustrating the pulling device of the second embodiment. FIG. 6A illustrates the stopper position and FIG. 6B illustrates the release position of a rail stopper portion.

In the present embodiment, a movable rail stopper 5 may be moved by rotation of a screw as a fastening member without removing the screw. Operations in a normal condition are the same as those of the second embodiment.

Regarding the fastening member 7*b* which is a screw, in a range of movement between the stopper position and the release position of the movable rail stopper 5, a length of a shaft portion in which a thread groove is formed is set so that screwing with the fixing plate 46 of the guide rail 4 is maintained.

When the containing cassette 1 is removed from the apparatus main body 102, the operator first rotates the screw as the fastening member 7*b* in a direction to loosen the same using a tool (i.e., a driver) from the front side of the apparatus main body 102. When the fastening member 7*b* is rotated, the fastening member 7*b* is moved to the front side of the apparatus main body and, in an interlocked manner, the movable rail stopper 5*b* is moved in the direction of arrow C which is the direction in which the containing cassette 1 is pulled. Finally, the movable rail stopper 5*b* reaches the release position where the containing cassette 1 may be pulled and removed from the apparatus main body 102.

The present embodiment has a robust stopper configuration, as in the second embodiment, while the operator may move the rail stopper 5 to the release position by an operation from the front side of the apparatus. Therefore, high robustness and high maintainability are achieved at the same time. Since it is not necessary to remove the screw as the fastening member 7*b* and the movable rail stopper 5*b* may be moved by rotating the screw, the operation to move the movable rail stopper 5*b* is easy.

In the second and third embodiments, examples in which the stopper of the upper guide rail portion 41 is fixed and the stopper of the lower guide rail portion 42 is movable are described. Alternatively, however, the stopper of the lower guide rail portion 42 may be fixed and the stopper of the upper guide rail portion 41 may be movable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-212750 filed Oct. 10, 2013, which is hereby incorporated by reference herein in its entirety.

What is claimed is:

1. A sheet containing apparatus comprising:

a containing portion configured to contain a sheet on which an image is to be formed and configured to be slidably supported by an apparatus main body;

a pair of guide rails provided in the apparatus main body and facing each other in an up-down direction, the guide rails being configured to guide a slide movement of the containing portion;

a guide portion provided in the containing portion and guided by the pair of guide rails between the pair of guide rails;

an engaging portion provided at the guide portion, the engaging portion including a first projecting portion projecting upward and a second projecting portion projecting downward;

a first stopper provided to project from one guide rail of the pair of guide rails toward the other guide rail of the pair of guide rails, and configured to abut one of the first projecting portion and the second projecting portion to regulate removal of the containing portion from the apparatus main body; and a second stopper provided to project from the other guide rail toward the one guide rail, and configured to abut the other of the first projecting portion and the second projecting portion to regulate removal of the containing portion from the apparatus main body, wherein the first stopper is movable from a position at which removal of the containing portion from the apparatus main body is regulated where a distance between the first stopper and the second stopper is shorter than a thickness in the up-down direction of the engaging portion to a position at which removal of the containing portion from the apparatus main body is released where the distance between the first stopper and the second stopper is longer than the thickness of the engaging portion.

2. The sheet containing apparatus according to claim 1, further comprising an operating unit that is operated when an operator moves the first stopper, the operating unit being connected to the first stopper.

3. The sheet containing apparatus according to claim 2, further comprising: a guide unit which includes the pair of guide rails and a side surface portion which connects the pair of guide rails, the guide unit having a substantially U-shaped cross section, wherein the operating unit is provided outside the guide unit formed in the substantially U-shape.

4. The sheet containing apparatus according to claim 3, wherein the operating unit is provided outside the guide unit through an opening provided in the side surface portion.

5. The sheet containing apparatus according to claim 3, wherein the operating unit is provided outside the guide unit through an opening formed in one of the pair of guide rails.

6. The sheet containing apparatus according to claim 2, wherein the operating unit includes a fixing member for fixing the first stopper at a position at which removal from the apparatus main body is regulated.

7. The sheet containing apparatus according to claim 6, wherein the fixing member is a screw disposed between the first stopper and the apparatus main body.

8. The sheet containing apparatus according to claim 7, wherein the first stopper is moved from the position at which removal of the containing portion from the apparatus main body is regulated to the position at which removal of the containing portion from the apparatus main body is released by rotating the screw.

9. The sheet containing apparatus according to claim 2, wherein the operating unit is provided so as to be operated from a direction in which the containing portion is pulled.

10. The sheet containing apparatus according to claim 1, wherein the first stopper is movable in a sliding direction from a position at which removal of the containing portion from the apparatus main body to a position at which removal of the containing portion from the apparatus main body.

11. The sheet containing apparatus according to claim 1, wherein the engaging portion provided at an end portion in a sliding direction of the guide portion.

12. A sheet containing apparatus, comprising:

a containing portion configured to contain a sheet on which an image is to be formed and configured to be detachably attached to an apparatus main body;

a pair of guide rails provided in the apparatus main body, and configured to guide pulling of the containing portion;

a guide portion provided in the containing portion and guided by the pair of guide rails between the pair of guide rails;

a first stopper provided in one guide rail of the pair of guide rails to project toward the other guide rail of the pair of guide rails;

a second stopper provided in the other guide rail to project toward the one guide rail;

a first projecting portion provided in the guide portion to project upward a second projecting portion provided in the guide portion to project downward, one of the first projecting portion and the second projecting portion engaging the first stopper and the other of the first projecting portion and the second projecting portion engaging the second stopper so as to regulate removal of the containing portion from the apparatus main body; and a screw configured to fix the first stopper and, to move the first stopper by being rotated.

13. The sheet containing apparatus according to claim 12, wherein the screw causes, when being rotated, the first stopper to move along a direction in which the containing portion is pulled.

14. The sheet containing apparatus according to claim 12, further comprising: a guide unit which includes the pair of guide rails and a side surface portion which connects the pair of guide rails, the guide unit having a substantially U-shaped cross section, and a fastening portion connected to the first stopper, provided to extend outside the guide unit from an opening formed in the guide unit, and fastened by the screw to fix the first stopper.

15. An image forming apparatus comprising:

a sheet containing apparatus; and an image forming unit configured to form an image fed from the sheet containing apparatus, wherein the sheet containing apparatus includes, a containing portion configured to contain a sheet on which an image is to be formed and configured to be slidably supported by an apparatus main body;

a pair of guide rails provided in the apparatus main body and facing each other in an up-down direction, the guide rails being configured to guide a slide movement of the containing portion;

a guide portion provided in the containing portion and guided by the pair of guide rails between the pair of guide rails;

an engaging portion provided at the guide portion, the engaging portion including a first projecting portion projecting upward and a second projecting portion projecting downward;

a first stopper provided to project from one guide rail of the pair of guide rails toward the other guide rail of the pair of guide rails, and configured to abut one of the first projecting portion and the second projecting portion to regulate removal of the containing portion from the apparatus main body; and a second stopper provided to project from the other guide rail toward the one guide rail, and configured to abut the other of the first projecting portion and the second projecting portion to regulate removal of the containing portion from the apparatus main body, wherein the first stopper is movable in a sliding direction from a position at which removal of the containing portion from the apparatus main body is regulated where a distance between the first stopper and the second stopper is shorter than a thickness in the up-down direction of the engaging portion to a position at which removal of the containing portion from the apparatus main body is released where the distance between the first stopper and the second stopper is longer than the thickness of the engaging portion.

16. An image forming apparatus comprising:

a sheet containing apparatus; and an image forming unit configure to form an image fed from the sheet containing apparatus, wherein the sheet containing apparatus includes, a containing portion configured to contain a sheet on which an image is to be formed and configured to be detachably attached to an apparatus main body;

a pair of guide rails provided in the apparatus main body, and configured to guide pulling of the containing portion;

a guide portion provided in the containing portion and guided by the pair of guide rails between the pair of guide rails;

a first stopper provided in one guide rail of the pair of guide rails to project toward the other guide rail of the pair of guide rails;

a second stopper provided in the other guide rail to project toward the one guide rail;

a first projecting portion provided in the guide portion to project upward;

a second projecting portion provided in the guide portion to project downward, wherein one of the first projecting portion and the second projecting portion engages the first stopper and the other of the first projecting portion and the second projecting portion engages the second stopper so as to regulate removal of the containing portion from the apparatus main body; and a screw configured to fix the first stopper and, to move the first stopper by being rotated.

* * * * *